United States Patent [19]

Merl

[11] 4,454,410

[45] Jun. 12, 1984

[54] MULTI-VARIABLE ANALOG COMPUTER

[75] Inventor: Milton J. Merl, New City, N.Y.

[73] Assignee: Marlboro Marketing, Inc., New York, N.Y.

[21] Appl. No.: 322,605

[22] Filed: Nov. 18, 1981

[51] Int. Cl.[3] ..... G06C 3/00

[52] U.S. Cl. ..... 235/89 R; 235/70 R

[58] Field of Search ..... 235/69, 70 R, 89 R

[56] References Cited

U.S. PATENT DOCUMENTS 2,485,892 10/1949 Kirschbaum ..... 235/89 R 3,034,708 5/1962 Bean, Jr. ..... 235/70 R X

*Primary Examiner*—Benjamin R. Fuller

*Attorney, Agent, or Firm*—Wolder, Gross & Yavner

[57] ABSTRACT

An analog computer for solving and displaying an answer to a multivariable problem includes a bottom plate upon which a matrix of the solution set to the problem appears. Overlying the bottom plate is a series of aperture plates, corresponding in number to the number of variables. Each plate is provided with an aperture dimensioned to display the solution subset corresponding to the solution to the problem for a variable value as set by the positioning of the plate. When each plate is so positioned, the solution to the problem defined by the variable values set appears through all the apertures.

2 Claims, 10 Drawing Figures

4
3
3
4
16
18
28
26
30
78
58c
58b
58a
$C_2$
$C_1$
$C_0$
C
24c
22c
$B_2$
$B_1$
$B_0$
B
24b
22b
14
$A_0$
$A_1$
$A_2$
A
22a
24a
20

FIG. 5

| | 50a | 52a | 54a | 50b | 52b | 54b | 50c | 52c | 54c |
|---|---|---|---|---|---|---|---|---|---|
| 34 → | $A_0B_0C_0$ | $A_0B_0C_1$ | $A_0B_0C_2$ | $A_0B_1C_0$ | $A_0B_1C_1$ | $A_0B_1C_2$ | $A_0B_2C_0$ | $A_0B_2C_1$ | $A_0B_2C_2$ |
| 36 → | $A_1B_0C_0$ | $A_1B_0C_1$ | $A_1B_0C_2$ | $A_1B_1C_0$ | $A_1B_1C_1$ | $A_1B_1C_2$ | $A_1B_2C_0$ | $A_1B_2C_1$ | $A_1B_2C_2$ |
| 38 → | $A_2B_0C_0$ | $A_2B_0C_1$ | $A_2B_0C_2$ | $A_2B_1C_0$ | $A_2B_1C_1$ | $A_2B_1C_2$ | $A_2B_2C_0$ | $A_2B_2C_1$ | $A_2B_2C_2$ |
| | 44 | | | 46 | | | 48 | | |

FIG. 6

| | 60 | | | 62 | | |
|---|---|---|---|---|---|---|
| 68 → | $A_0B_0C_0D_0$ | $A_0B_0C_1D_0$ | $A_0B_0C_2D_0$ | $A_0B_1C_0D_0$ | $A_0B_1C_1D_0$ | $A_0B_1C_2D_0$ |
| 70 → | $A_1B_0C_0D_0$ | $A_1B_0C_1D_0$ | $A_1B_0C_2D_0$ | $A_1B_1C_0D_0$ | $A_1B_1C_1D_0$ | $A_1B_1C_2D_0$ |
| 72 → | $A_0B_0C_0D_1$ | $A_0B_0C_1D_1$ | $A_0B_0C_2D_1$ | $A_0B_1C_0D_1$ | $A_0B_1C_1D_1$ | $A_0B_1C_2D_1$ |
| 74 → | $A_1B_0C_0D_1$ | $A_1B_0C_1D_1$ | $A_1B_0C_2D_1$ | $A_1B_1C_0D_1$ | $A_1B_1C_1D_1$ | $A_1B_1C_2D_1$ |
| | 64 | | | 66 | | |

MULTI-VARIABLE ANALOG COMPUTER

Today's retail consumer is subject to a multitude of items on store shelves, each purporting to be especially suited to his or her needs. The display counter of a typical supermarket or drug store, for example, contains an innumerable number of hair care products, each representing to be the correct product to use for a certain customer type. Indeed, a given manufacturer often produces a variety of products, each formulated for specific user characteristics. Such hair care formulations have been designed for the various hair types, such as thick or thin; various scalp conditions, such as dry or oily; and for various environments such as dry, hot or humid climates. These characteristics often interact in subtle ways, such that it is difficult for the consumer to make a rational decision as to the ultimate product to buy for most successful results for his or her specific combination of characteristics. Obviously, an incorrect choice by the customer leads to product dissatisfaction, and leads the customer away from that product line when a subsequent purchase is contemplated.

Various approaches have been attempted to provide methods by which a potential purchaser can be apprised of the proper product of a product line for his or her needs and preferences. Where immediate response is not contemplated or desired, a fill-in questionnaire, to be completed and sent in by the prospective purchaser, can be used. The questionnaire permits the analysis of the individual's characteristics by the offering company, which then delivers to the customer a "customized" profile of the appropriate product or products to be used. This procedure has the obvious disadvantage that much buying includes an element of impulse, and thus requires a choice decision to be made within the selling area at the moment of purchase. It also delays the purchase from a time of perceived need to a later, often undefined date, thus possibly avoiding the sale.

A second method of assisting the customer consists of providing an electronically programmed computer apparatus at the store site. Such an apparatus, while providing an immediate response, is often expensive, relatively sensitive to abuse, and often requires the use of a semi-skilled operator. Thus such devices are normally found within department stores and boutiques where the services of full-time salespeople can be utilized.

A third type of assistance consists of one or more charts located adjacent the products to be sold. The potential customer locates his or her characteristics on the charts and, through a series of instruction steps, travels through the charts until the appropriate solution is reached. This approach, while having the advantage of ease of manufacture and economy, is often confusing to the customer, is somewhat time-consuming and can easily lead to errors.

Each of these types of solutions has one feature in common. Each attempts to provide to the user a specific solution to a multi-variable problem having a finite number of possible solutions. In the case of hair care products three variables may be encounted: hair type, scalp condition, and environment. Each of the above methods, for each possible combination of variables, would offer to the potential customer a specific solution, i.e. the specific hair care product or products that should be utilized by the customer with the given input characteristics. This product or products are then hopefully purchased by the customer and used satisfactorily by him or her.

It is therefore an object of the present invention to provide a mechanical analog computer designed to solve a multi-variable problem.

A further object of the present invention is to provide the means by which a potential customer can be directed to an appropriate product from a group of similar products, each being appropriate for a specific set of user characteristics.

Yet a further object of the present invention is to provide a relatively simple and easy to operate mechanical device for the solution of a multi-variable problem.

A still further object of the present invention is to provide an easily programmable mechanical computer which may be located at a selling site to provide an immediate solution to a multi-variable problem relating to the sale of related products.

In accordance with the above and other objects and advantages, the mechanical analog computer of the present invention comprises a base plate upon which the entire solution set to the problem is set forth in a Cartesian format. Overlaying the base plate are a series of grid selector plates, one for each of the variables of the problem. Each plate is slideable in a plane parallel to the plane of the surface of the base plate among a series of positions or station locations, each position or station location corresponding to a value for the variable. Means are provided on each selector plate to expose the subset of the solution set corresponding to the set of problem answers or answer information bits for the value of the variable chosen by the position of the selector plate. The selector plates are so arranged that only the intersection of the solution sets for each variable value is exposed by all the selector plates. This intersection corresponds to a specific answer value which is the solution to the problem for the specific values of the variables set by the grid selector plates.

The above features, advantages and objects of the present invention will be more fully appreciated with reference to the following detailed description of a preferred, illustrative embodiment when taken in conjunction with the following drawings, wherein:

FIG. 5 is a representation of the solution set matrix for the three variable problem of the embodiment of the invention of FIGS. 1–4;

FIG. 6 is a representation of the solution set for a four variable problem; and FIGS. *7a–7d* are diagrammatic representations of the layout of the selector plates used in connection with the solution set matrix of FIG. 6.

Figure 1:
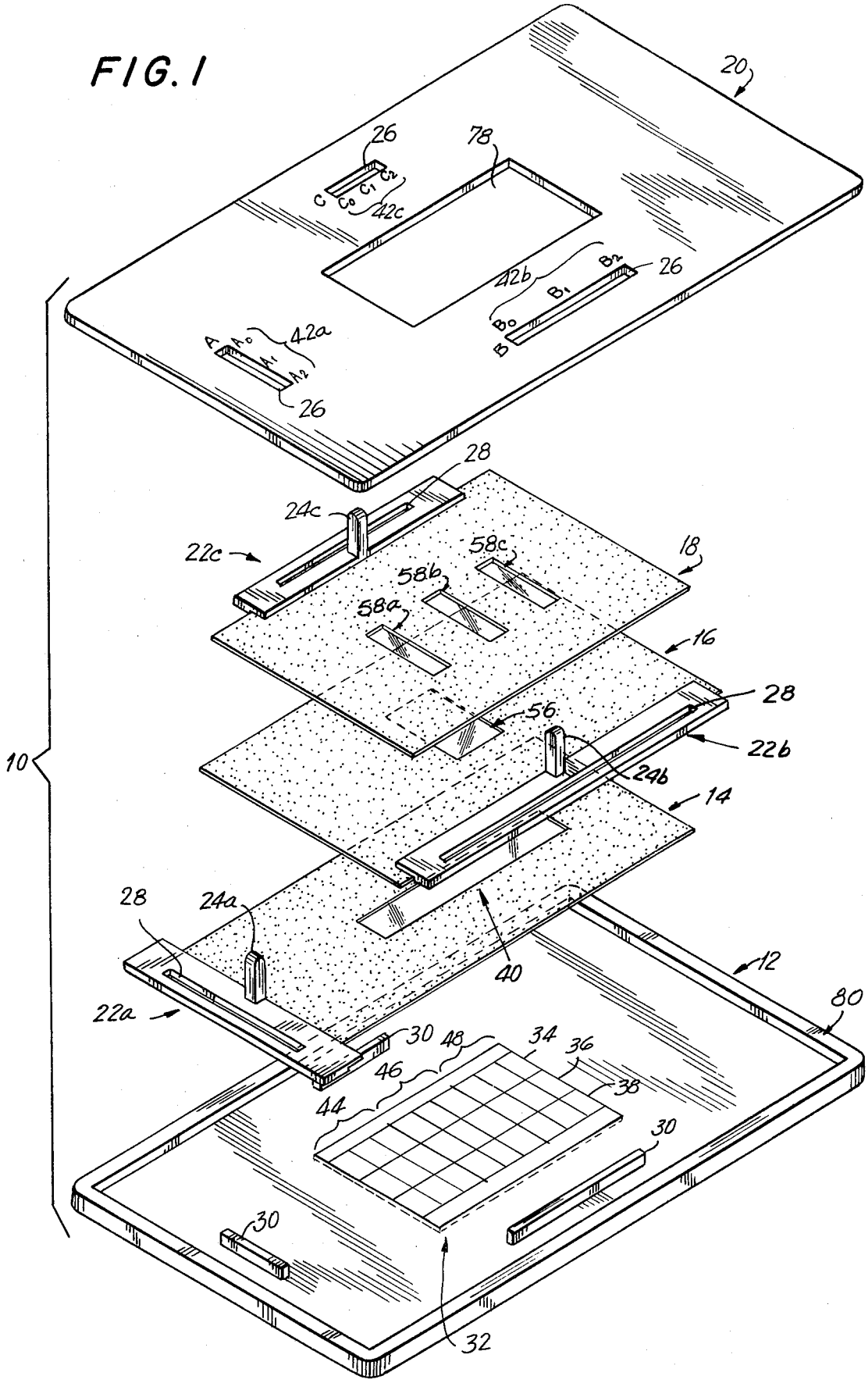
FIG. 1 is an exploded perspective view of the apparatus of the present invention.

Referring initially to FIG. 1, the apparatus 10 of the present invention includes planar base plate 12 overlaid by selector plates 14, 16 and 18, each of which is slideable in a direction parallel to the top surface of base plate 12. Lying atop the selector plates is planar top piece 20.

The number of selector plates of the apparatus corresponds to the number of input variables. In the embodiment shown in FIGS. 1–5, there are three such variables. The term "input variable" or "variable" as used herein refers generally to a characteristic or feature comprising a part of the problem to be solved, and which may assume any one of a plurality of states or value. With respect to the present invention as adapted to be used to indicate the correct hair care product or products, for example, the three variables might be the aforementioned hair type, scalp condition and environment, each of which can assume any of its states or values independently of the value of the others variables. For example, for each of three hair types, namely thin, average, or thick there may be one of three scalp conditions—oily, normal or dry, as well as any one of three environmental conditions—dry, average or humid.

Each combination of variables, of which there are 27 ($3\times3\times3$) could conceivably direct the purchaser to a specific hair care product or combination of products, although it is recognized that in reality there may well be some duplication, although such duplication may occur on an apparently random basis.

As seen in FIG. 1, each of selector plates 14, 16 and 18 are each provided with positioning means 22*a, b* and *c*, located along an edge of the selector plate it controls. Arms 24*a–c* of positioning means 22*a, b* and *c* each project though a slot 26 on top piece 20.

Each of positioning means 22*a, b* and *c* is provided with a guide slot 28, which is dimensioned to receive an elongated guide pin 30, projecting upward from base plate 12. Guide pin 30 both constrains the respective selector plate to move along the line defined by the respective slot 28 and, in conjunction with the length of the slot, defines the limits of the travel of the selector plate along that line.

Located adjacent each slot 26 on top piece 20 are appropriate identifying indicia 42*a–c* which correspond to and identify the possible states or values for the variable represented by the selector plate and positioning means. In the embodiment shown in the figures, in which each variable; hair type ["A"], scalp condition ["B"] and environment ["C"] can attain any one of three states, each set of identifying indicia 42*a, b* and *c* indicates three positions for the respective arm 24*a, b* and *c* and selector plate.

Positioned on base plate 12 is solution set matrix 32, which displays the 27 possible solutions to the hair product problem generated by the three input variables. As can be best seen in FIG. 5, the individual solution elements for each value of a given input variable are arranged along a line or lines perpendicular to the direction of travel of the respective arm 24 and its corresponding selector plate 14, 16 or 18. Thus, with respect to the first variable A, which is represented by selector plate 14, the solution subsets for the A values $A_0$, $A_1$ and $A_2$ are aligned in parallel rows 34, 36 and 38, each of which is perpendicular to the direction of travel of selector plate 14. Aperture 40 is located on selector plate 14 such that the solution subset for the value of variable A set by its arm 24*a* appears therethrough.

When arm 24*a* is set opposite the indicia 42*a* corresponding to the first variable value $A_0$, row 34 of the answer matrix appears through aperture 40. As arm 24*a* is moved to the position corresponding to value $A_1$ or $A_2$ the corresponding row 36 or 38 appears through aperture 40.

The solution subsets for the three possible values for second variable B are grouped in three column groups 44, 46, 48, each column group comprising three columns. Selector plate 16 sweeps across the columns, and is positioned by arm 24*b* being set opposite the indicia 42*b* corresponding to the value of variable B desired. When arm 24*b* is set opposite the indicia 42*b* corresponding to B variable value $B_0$, the nine values of the solution subset of column group 44 appear within aperture 56. As arm 24*a* is moved to the position corresponding to values $B_1$ or $B_2$, the corresponding column group 46 or 48 appears within the aperture.

When only the two variables are utilized, the resultant solution set matrix 32 is of little complexity, since the two variables can easily be laid out upon the two dimensional surface. When the number of variables increases beyond two, as in the presented illustrative embodiment, it becomes more difficult to lay out such a multi-dimensional solution space on the two dimensional matrix. In such a case, matrix 32 actually becomes a series of sub-matrices as illustrated in the figures.

The solution subsets for the three possible values of third variable C are grouped in three dispersed column sets 50*a, b, c*; 52*a, b, c*; and 54*a, b, c*. As each solution subset 50*a, b, c*, 52*a, b, c* or 54*a, b, c* is in three parts, selector plate 18 has apertures 58*a, b, c*. As with the other variables, when arm 24*c* is set adjacent indicia 42*c* corresponding to third variable value $C_0$, columns 50*a, b, c* are oriented under apertures 58*a, b, c*. As arm 24*c* is moved to the position corresponding to variable value $C_1$ or $C_2$, corresponding solution subset columns 52*a, b, c* or 54*a, b, c* are exposed through apertures 58.

The basic requirement for the mapping of any solution set into the matrix form is that the solution subsets for each value of a variable be laid out in a regular pattern such that the appropriate selector plate can be moved in a line to expose the proper solution subset.

By proper layout of the subsets, it is possible to solve higher order problems. FIG. 6 illustrates the solution set matrix for a problem consisting of four input variables A, B, C and D; A having two possible states; B two states; C and D; A having two possible states; B two states; C three states; and D two states. To define the solution set for such a problem a total of 24 ($2\times2\times3\times2$) answer elements must be laid out.

As shown in FIG. 6, one possible layout is composed of four subset groups; 60, 62, 64 and 66. Groups 60 and 62 define the solution subset for the reduced three variable problem when $D=D_0$; groups 64 and 66 define the solution subset for the problem when $D=D_1$. Similarly, groups 60 and 64 define the solution subset for the reduced three variable problem where $B=B_0$ and groups 62 and 66 define the subset for $B=B_1$. Through all the groups 60, 62, 64 and 66 parallel rows 68 define the solution subset for $A=A_0$ and rows 70 define the solution subset for $A=A_1$. Columns 72, 74 and 76 define the subsets for $C=C_0$, $C=C_1$, and $C=C_2$, respectively.

FIGS. *7a–7d* details the aperture layout for the four selector plates required to solve the four variable problem of FIG. 6. FIG. *7a* illustrates the two-aperture layout for variable A such that rows 68 or 70 can be displayed. FIG. *7b* shows the aperture configuration for variable B, such that groups 60 and 64 or 62 and 66 can be displayed. FIG. *7c* illustrates the two aperture configuration required for variable C to permit columns 72, 74 or 76 to be displayed. FIG. *7d* shows the aperture for variable D such that groups 60, 62 or 64, 66 can be displayed. In each case the arrows indicate direction of selector plate movement.

Using a similar procedure, in which submatrices are defined as required, a solution matrix can be laid out for other multi-variable problems.

Referring generally to FIGS. 1–4, in which the details of construction of the invention with respect to the three variable problem are illustrated, base plate 12 and top plate 20 may be constructed of a suitable plastic or other rigid material. Viewing window 78 in top plate 20 is located to overlay solution set matrix 32 and is sized such that all solution set elements can be viewed therethrough. Guide pins 30 may be formed as an integral part of the base plate, which advantageously is formed with peripheral lip 80 on which top plate 20 sits.

Figure 3:
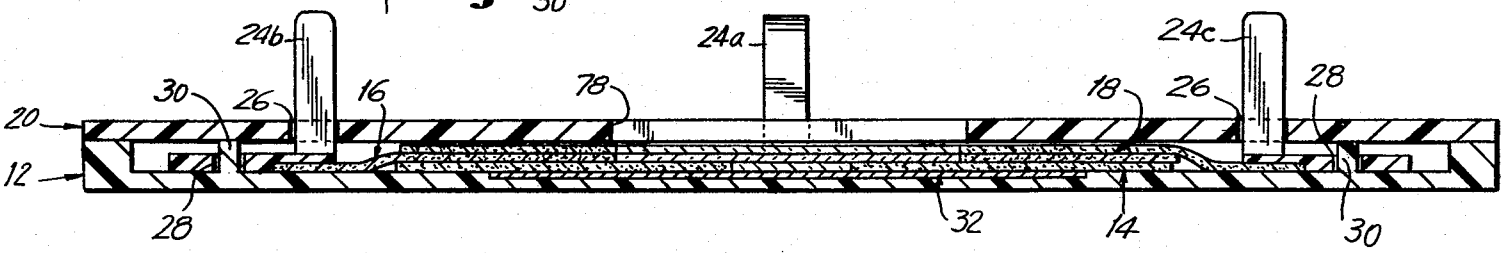
FIG. 3 is a side section view taken along line 3—3 in FIG. 2.
Figure 4:
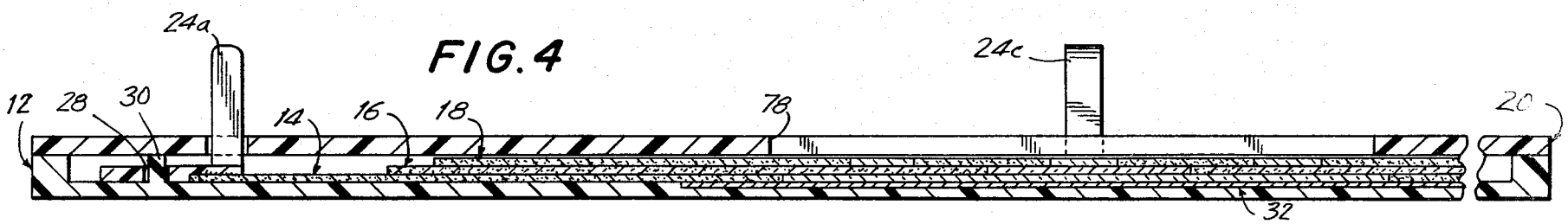
FIG. 4 is a section view taken along 4—4 of FIG. 2.
Figure 7A:
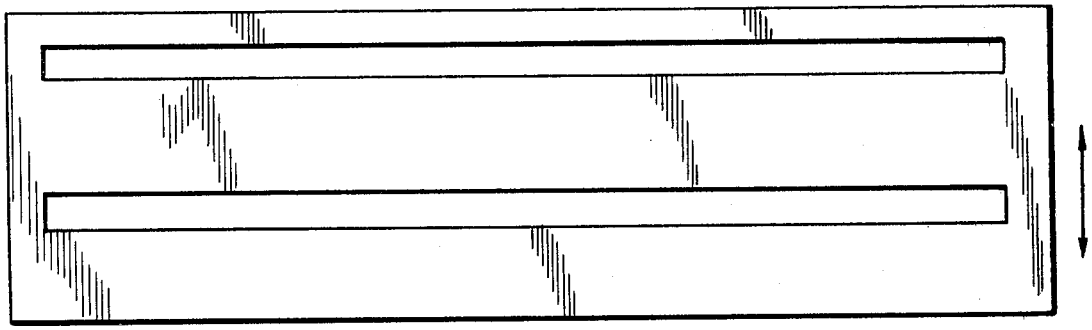
Figure 7B:
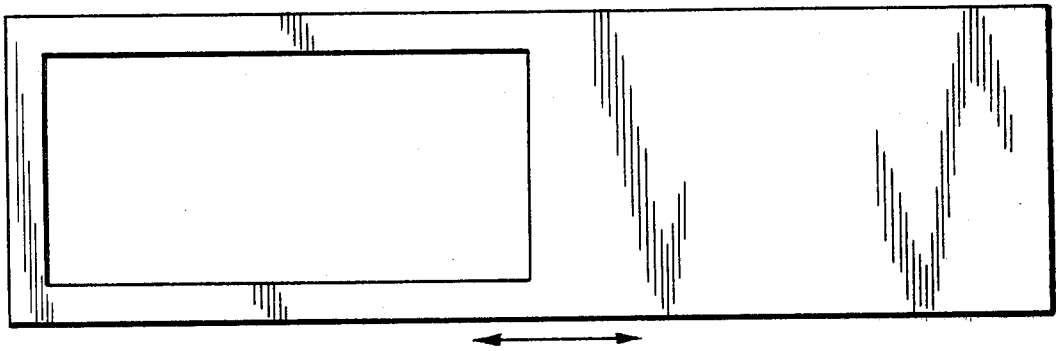
Figure 7C:
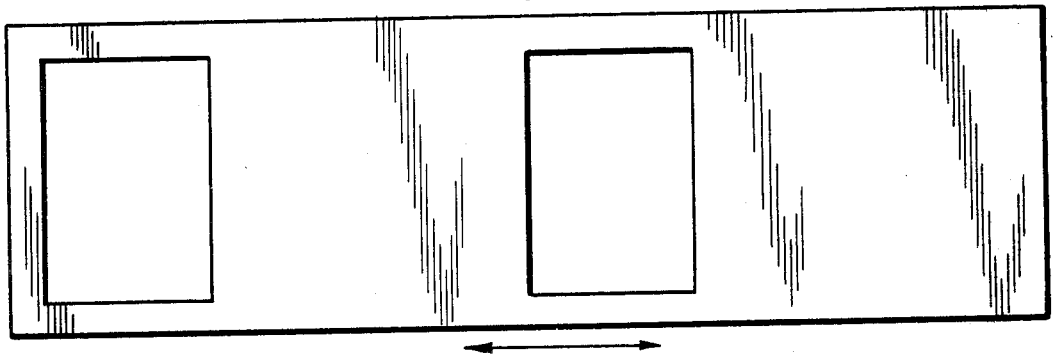
Figure 7D:
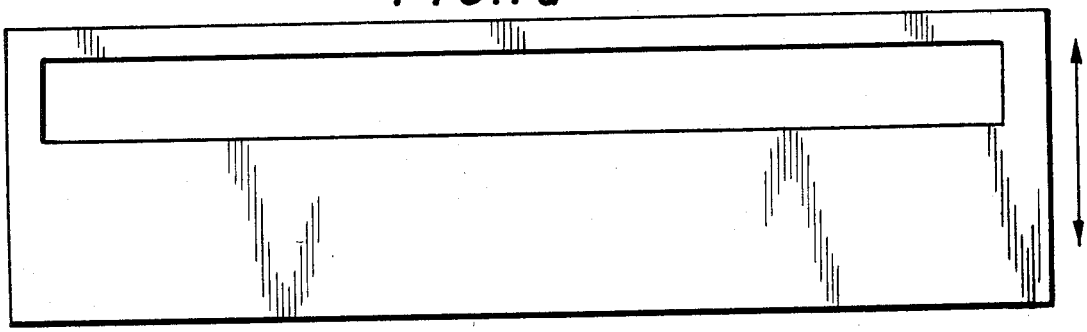

As can be appreciated from FIGS. 3 and 4, selector plates 14, 16 and 18 can be fashioned from a clear flexible plastic sheet material, darkened over its surface except for those areas defining the aperture or apertures. Alternatively, an opaque material may be used for the selector plates, with the apertures cut therein.

Figure 2:
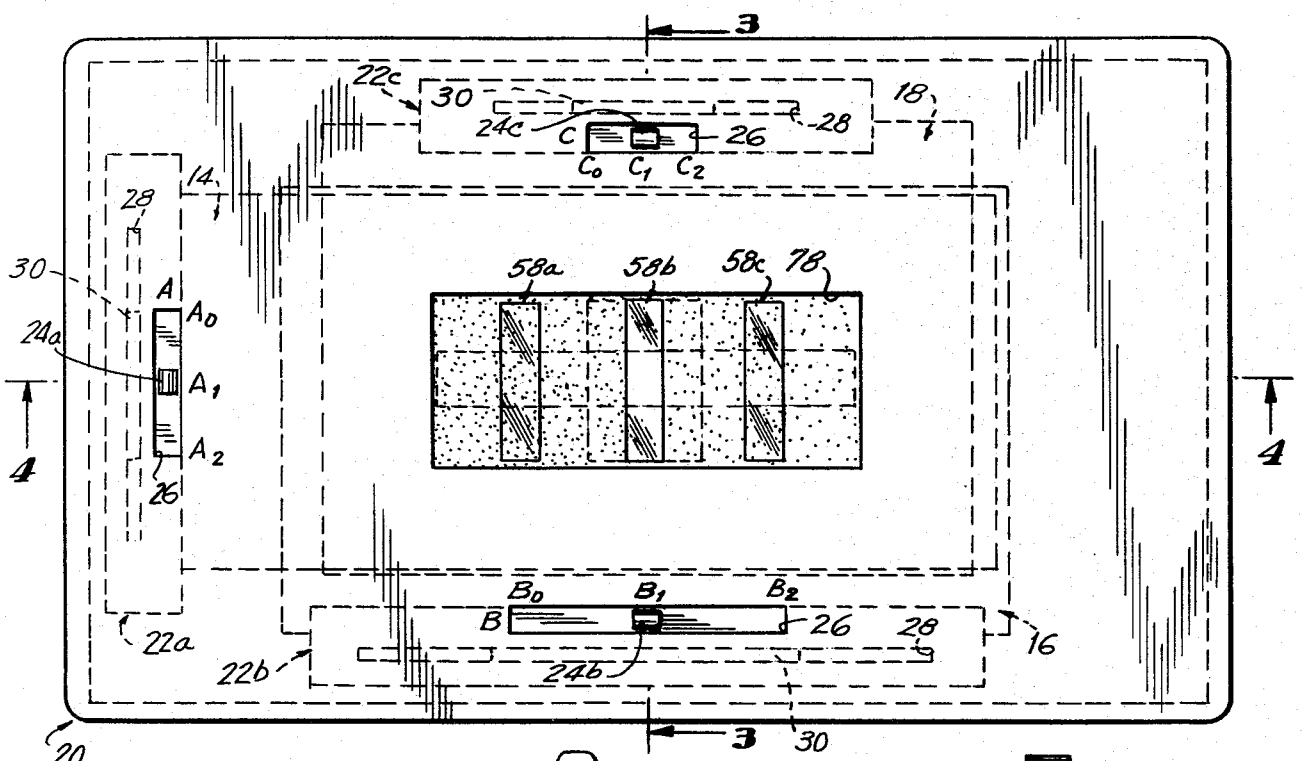
FIG. 2 is a top plan view of the apparatus of the present invention showing the configuration of the grid selector plates in phantom.

As illustrated in FIG. 2, the dimensions of the selector plates 14, 16 and 18 must be such as to permit full travel of the plate so that the answer matrix can be fully scanned by the apertures. Care must be exercised that the top and bottom edges of selector plate 14, for example, do not hit arms 24*b* or 24*c* before the full range of travel of the plate is realized.

The specific locations of the arms 24*a, b* and *c* are not critical. The general positioning of the arms, with regard to their being located on the top or bottom or a side, is generally controlled by the layout of the solution set matrix. When the arm is direct coupled to a selector plate the motion of the arm and plate is perpendicular to the orientation of the solution subsets for the variable. For the solution set matrix of FIG. 6 the selector plates shown in FIGS. *7a* and *7d* must move vertically; the selector plate of FIG. *7b* and *7c*—horizontally. As additional variables are introduced provision must be made for such additional arms.

It is not necessary, of course, for the arms to be directly coupled to the selector plates. Suitable linkages can be utilized such that the arms are located in a row, for example, such that variable data can be reproduced adjacent each arm. Linkages can also be introduced to increase or decrease arm travel, as required or to permit a lever movement to describe motions more appropriate or representative of the problem sought to be solved.

It is further not necessary for the actual solution data to appear on the solution set matrix. Size consideration may prohibit the inclusion of a complete list of products, for example, called for the specific setting of the input variables. Further, the solution set matrix may include duplicate solution set elements. It this may be advantageous to provide a supplementary chart in conjunction with the matrix in which the matrix gives an answer number or letter which corresponds to a set of products set forth in the chart.

The apparatus as set forth herein represents an economical and efficient way for a consumer or other nontechnical person to rationally solve a multi-variable problem. The problems need not be of a mathematical nature, as the apparatus can be used to provide solutions for any multi-variable problem in which the elements of the solution set can be arrayed in a matrix format. The slideable selector plates isolate the values of the solution set corresponding to the solution subset for the variable value chosen by the position of the selector plate arm, and as the selector set value common to each solution subset provides the solution to the problem as set by the solution set arms.

It is to be recognized that numberous variations, adaptations and modifications to the invention as described herein may be apparent to one skilled in the art, and it is intended that such variations, adaptations and modifications are to be within the scope of the invention as claimed. For example, it is not necessary for each aperture plate to be made movable. The base plate carrying the solution set matrix can be made movable with respect to one or more fixed aperture plates.

I claim:

1. Apparatus for displaying a solution to a three variable problem comprising a planar base member having a plurality of answer information bits thereon arranged in a Cartesian grid format of rows and columns, said bits corresponding to the set of solutions to the problem, a first variable selector plate overlying said base and movable in a direction parallel to said columns between a plurality of station locations, each corresponding to a possible assumed value for the first variable, said first selector plate having an aperture located so as to expose a row of information bits corresponding to the subset of solutions for the problem when said first variable takes the value corresponding to said station location, a second variable plate overlying said first variable plate and movable in a direction parallel to said rows between a plurality of station locations each corresponding to a possible assumed value for the second variable, said second variable plate having an aperture located so as to expose three columns of information bits corresponding to the subset of solutions for the problem when said second variable takes the value corresponding to said station location, and a third variable plate overlying said second variable plate and movable in a direction parallel to said rows between a plurality of station locations each corresponding to a possible assumed value for the third variable, said third variable plate having three apertures located so as to expose three columns of information bits corresponding to the subset of solutions for the problem when said third variable takes the value corresponding to said station location such that a single information bit corresponding to the solution to the problem for given values of the three variables appears through each of said apertures when said variable plates are positioned at stations corresponding to said variable values.

2. Apparatus for displaying a solution to a problem having at least three variables, comprising a planar base member having a plurality of information bits thereon arranged in a Cartesian grid format of rows and columns, said bits corresponding to the set of solutions to the problem and arranged such that the solution subset for a given value of a given variable is aligned either in column or row order, the collection of said subsets being arranged both in column and row orders; a plurality of variable selector plates equal to the number of problem variables overlying said base, each of said plates movable in a direction parallel to the rows or columns wherein the solution subset for the variable are found between a plurality of station locations corresponding to the possible assumed values for the variable, each of said plates having at least one aperture dimensioned and arranged to expose the subset of information bits corresponding to the solution subset for the variable value corresponding to the station position of the plate, such that a single information bit corresponding to the solution to the problem for given values of the variables appears through each of said plates when said plates are each positioned at the station corresponding to the variable values.

* * * * *